US006089214A

United States Patent [19]

Anderson

[11] Patent Number: 6,089,214

[45] Date of Patent: Jul. 18, 2000

[54] ENGINE SPARK IGNITION SYSTEM CAPACITIVE COUPLER

[75] Inventor: Gerald B. Anderson, Westminster, Calif.

[73] Assignee: United States Clean Air Company (LLC), Fountain Valley, Calif.

[21] Appl. No.: 09/184,814

[22] Filed: Nov. 2, 1998

[51] Int. Cl.[7] ..... F02P 3/02

[52] U.S. Cl. ..... 123/620; 123/647

[58] Field of Search ..... 123/620, 647, 123/143 C

[56] References Cited

U.S. PATENT DOCUMENTS

| | | | |
|---|---|---|---|
| 4,407,256 | 10/1983 | Wolf | 123/647 |
| 5,031,587 | 7/1991 | Tharman | 123/647 |
| 5,179,919 | 1/1993 | Foltz, Jr. et al. | 123/143 C |
| 5,218,936 | 6/1993 | Pritz et al. | 123/647 |
| 5,353,758 | 10/1994 | Masuda et al. | 123/143 C |

*Primary Examiner*—John Kwon
*Attorney, Agent, or Firm*—United States Clean Air Company (LLC); Gerald B. Anderson; Thomas A. Casso

[57] ABSTRACT

An engine spark ignition system capacitive coupler for capacitively coupling the non-firing spark plug wires to the firing spark plug wire. The device includes a first plate having a first side and a second side, the first side having at least two spaced, electrically conductive surface portions, each surface portion forming a first plate of a capacitor. A second plate of each capacitor is formed by an electrically conductive surface portion disposed in spaced and insulated relationship to the at least two surface portions upon the second side of the first plate. A second plate alignable and abuttable to the first plate and having first and second sides is abuttable to the first plate first side. At least two spaced electrically conductive members are disposed through the second plate. Each conductive member includes a first end for electrical contact with a spark plug wire and a second end for electrical contact with one of the at least two first plate, first side electrically conductive surface portions. A retaining plate is alignable with the second plate and is abuttable to the spark plug wires to retain them in electrical contact with the first ends of the conductive members. A base plate alignable and abuttable to the first plate and having first and second sides is abuttable to the first plate second side. An electrically conductive member is disposed through the base plate. The base plate electrically conductive member includes a first end for electrical contact with the first plate, second side electrically conductive surface portion and a second end disposed adjacent the base plate second side. A bolt is receivable through a threaded bore formed in the center of the retaining plate, a bore formed in the second plate, a bore formed in the first plate, and a threaded bore formed in the base plate to alignably attach the plates together.

8 Claims, 3 Drawing Sheets

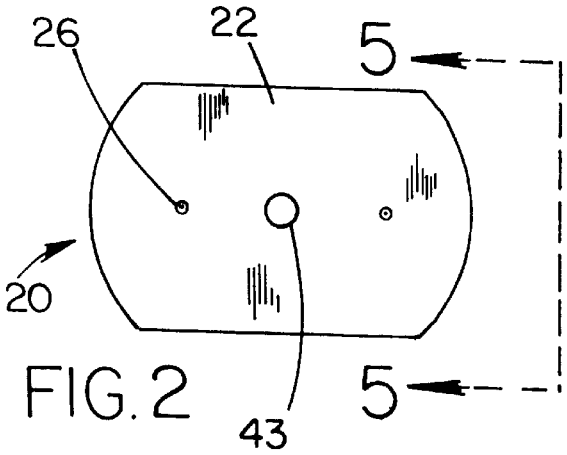
FIG. 2
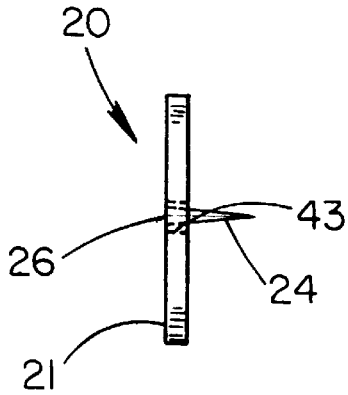
FIG. 5
FIG. 3
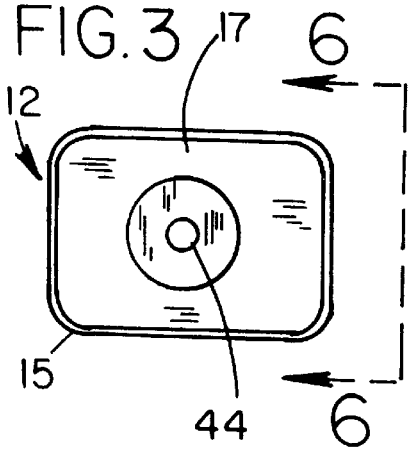
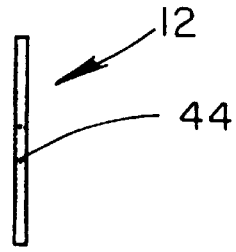
FIG. 6
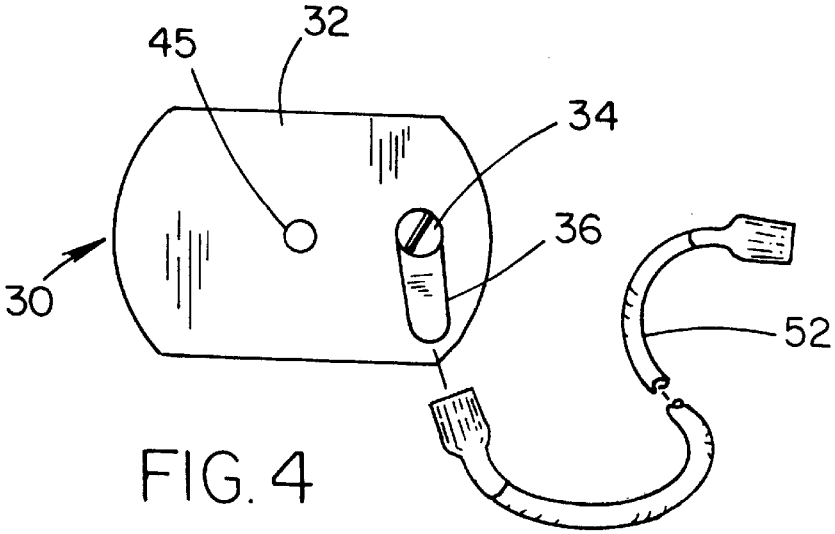
FIG. 4

ENGINE SPARK IGNITION SYSTEM CAPACITIVE COUPLER

BACKGROUND OF THE INVENTION

1. Field of the Invention

The present invention relates to spark ignition systems for internal combustion engines and more particularly pertains to a new engine spark ignition system capacitive coupler for capacitively coupling the non-firing spark plug wires, and thereby the non-firing spark plugs, to the firing spark plug wire.

With present day concerns about air quality and environmental degradation, the inefficient operation of the internal combustion engine continues to pose a serious challenge to engine designers and manufacturers. The incomplete and inefficient burning of combustion gases in the cylinders of the engine, in addition to creating pollutants, results in reduced fuel efficiency, reduced engine power, rough idling, and decreased engine and spark plug life.

2. Description of the Prior Art

The use of spark ignition systems for internal combustion engines is known in the prior art. It is known that a non-igniting condition produced by an electrostatic charge can be developed in each of the non-firing cylinders of the internal combustion engine responsive to the flow of current to the firing cylinder through the firing spark plug wire. The current flow induced in the non-firing spark plugs improves the combustibility of the fuel/air mixture in the cylinders by ionizing the gases in the cylinder and breaking down hydrocarbon molecules and thereby aiding in their combustion.

One device which has been utilized to create this non-igniting condition is disclosed in U.S. Pat. No. 4,269,160 issued to Irvin, Jr. The device includes a plurality of induction blocks having a longitudinal channel sized to receive a spark plug wire. Current flowing to each firing cylinder of the engine induces an electrical potential in a pair of plates disposed in the induction block on the firing wire. This potential in the plates of the induction block is communicated to corresponding plates of the other induction blocks on the non-firing spark plug wires inducing an electrostatic potential on the plates around the non-firing spark plug wires to communicate the electrical potential into the non-firing cylinders.

U.S. Pat. No. 3,949,718 to Turner discloses a corona coupling system having a plurality of corona coupling unit blocks which are individually snapped on the spark plug wires of the ignition system of an internal combustion engine. The blocks are interconnected by means of two generally parallel, insulated wires clamped in place and running through each block. A stamped conductive plate is positioned in each block and is electrically connected to the insulated wires. The successively built up and collapsing lines of force result in inductive build-up of voltage levels in the corona coupler to very high levels.

While these devices fulfill their respective, particular objectives and requirements, the aforementioned patents do not disclose a new engine spark ignition system capacitive coupler. The inventive device includes a first plate having a first side and a second side, the first side having at least two spaced, electrically conductive surface portions, each surface portion forming a first plate of a capacitor. A second plate of each capacitor is formed by an electrically conductive surface portion disposed in spaced and insulated relationship to the at least two surface portions upon the second side of the first plate. A second plate alignable and abuttable to the first plate and having first and second sides is abuttable to the first plate first side. At least two spaced electrically conductive members are disposed through the second plate. Each conductive member includes a first end for electrical contact with a spark plug wire and a second end for electrical contact with one of the at least two first plate, first side electrically conductive surface portions. A retaining plate is alignable with the second plate and is abuttable to the spark plug wires to retain them in electrical contact with the first ends of the conductive members. A base plate alignable and abuttable to the first plate and having first and second sides is abuttable to the first plate second side. An electrically conductive member is disposed through the base plate. The base plate electrically conductive member includes a first end for electrical contact with the first plate, second side electrically conductive surface portion and a second end disposed adjacent the base plate second side. In the embodiment having two capacitors formed on the first plate, a bolt is receivable through a threaded bore formed in the center of the retaining plate, a bore formed in the second plate, a bore formed in the first plate, and a threaded bore formed in the base plate to alignably attach the plates together. As will be appreciated by those skilled in the art, additional bolts may be employed for larger devices. The base plate conductive member second end includes a male connector for connecting two devices of the present invention as hereinbelow described.

In these respects, the engine spark ignition system capacitive coupler according to the present invention substantially departs from the conventional concepts and designs of the prior art, and in so doing provides an apparatus primarily developed for the purpose of capacitively coupling the non-firing spark plug wires to the firing spark plug wire.

SUMMARY OF THE INVENTION

In view of the foregoing disadvantages inherent in the known types of spark ignition systems for internal combustion engines now present in the prior art, the present invention provides a new engine spark ignition system capacitive coupler construction wherein the same can be utilized for capacitively coupling the non-firing spark plug wires to the firing spark plug wire.

The general purpose of the present invention, which will be described subsequently in greater detail, is to provide a new engine spark ignition system capacitive coupler apparatus and method which has many of the advantages of the spark ignition systems for internal combustion engines mentioned heretofore and many novel features that result in a new engine spark ignition system capacitive coupler which is not anticipated, rendered obvious, suggested, or even implied by any of the prior art spark ignition systems for internal combustion engines, either alone or in any combination thereof.

To attain this, the present invention generally comprises a first plate having a first side and a second side, the first side having at least two spaced, electrically conductive surface portions, each surface portion forming a first plate of a capacitor. A second plate of each capacitor is formed by an electrically conductive surface portion disposed in spaced and insulated relationship to the at least two surface portions upon the second side of the first plate. A second plate alignable and abuttable to the first plate and having first and second sides is abuttable to the first plate first side. At least two spaced electrically conductive members are disposed through the second plate. Each conductive member includes a first end for electrical contact with a spark plug wire and a second end for electrical contact with one of the at least two first plate, first side electrically conductive surface portions. A retaining plate is alignable with the second plate and is abuttable to the spark plug wires to retain them in electrical contact with the first ends of the conductive members. A base plate alignable and abuttable to the first plate and having first and second sides is abuttable to the first plate second side. An electrically conductive member is disposed through the base plate. The base plate electrically conductive member includes a first end for electrical contact with the first plate, second side electrically conductive surface portion and a second end disposed adjacent the base plate second side. A bolt is receivable through a threaded bore formed in the center of the retaining plate, a bore formed in the second plate, a bore formed in the first plate, and a threaded bore formed in the base plate to alignably attach the plates together.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new engine spark ignition system capacitive coupler apparatus and method which has many of the advantages of the spark ignition systems for internal combustion engines mentioned heretofore and many novel features that result in a new engine spark ignition system capacitive coupler which is not anticipated, rendered obvious, suggested, or even implied by any of the prior art spark ignition systems for internal combustion engines, either alone or in any combination thereof.

It is another object of the present invention to provide a new engine spark ignition system capacitive coupler which may be easily and efficiently manufactured and marketed.

It is a further object of the present invention to provide a new engine spark ignition system capacitive coupler which is of a durable and reliable construction.

An even further object of the present invention is to provide a new engine spark ignition system capacitive coupler which is susceptible of a low cost of manufacture with regard to both materials and labor, and which accordingly is then susceptible of low prices of sale to the consuming public, thereby making such engine spark ignition system capacitive coupler economically available to the buying public.

Still another object of the present invention is to provide a new engine spark ignition system capacitive coupler for capacitively coupling the non-firing spark plug wires to the firing spark plug wire.

Yet another object of the present invention is to provide a new engine spark ignition system capacitive coupler for reducing air pollution.

Still yet another object of the present invention is to provide a new engine spark ignition system capacitive coupler that increases fuel efficiency.

Even still another object of the present invention is to provide a new engine spark ignition system capacitive coupler that increases engine power.

Still yet another object of the present invention is to provide a new engine spark ignition system capacitive coupler that aids in the starting of a cold engine.

Even still another object of the present invention is to provide a new engine spark ignition system capacitive coupler that decreases erratic combustion in each cylinder and thereby promotes a smoother running engine.

Still yet another object of the present invention is to provide a new engine spark ignition system capacitive coupler that allows for the use of lower octane fuel.

Even still another object of the present invention is to provide a new engine spark ignition system capacitive coupler that breaks down solid combustion by-products which accumulate on the piston and cylinder surfaces in the combustion chamber.

Still yet another object of the present invention is to provide a new engine spark ignition system capacitive coupler that reduces oil contamination and prolongs oil filter life.

Even still another object of the present invention is to provide a new engine spark ignition system capacitive coupler that prolongs spark plug life.

Still yet another object of the present invention is to provide a new engine spark ignition system capacitive coupler that reduces carbon tracking in the distributor cap by reducing the voltage needed to jump the spark plug gap.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a plan view taken along line 2—2 of FIG. 1.

FIG. 3 is a plan view taken along line 3—3 of FIG. 1.

FIG. 4 is a plan view taken along line 4—4 of FIG. 1.

FIG. 5 is a side elevation view taken along line 5—5 of FIG. 2.

FIG. 6 is a side elevation view taken along line 6—6 of FIG. 3.

DESCRIPTION OF THE PREFERRED EMBODIMENT

Figure 1:
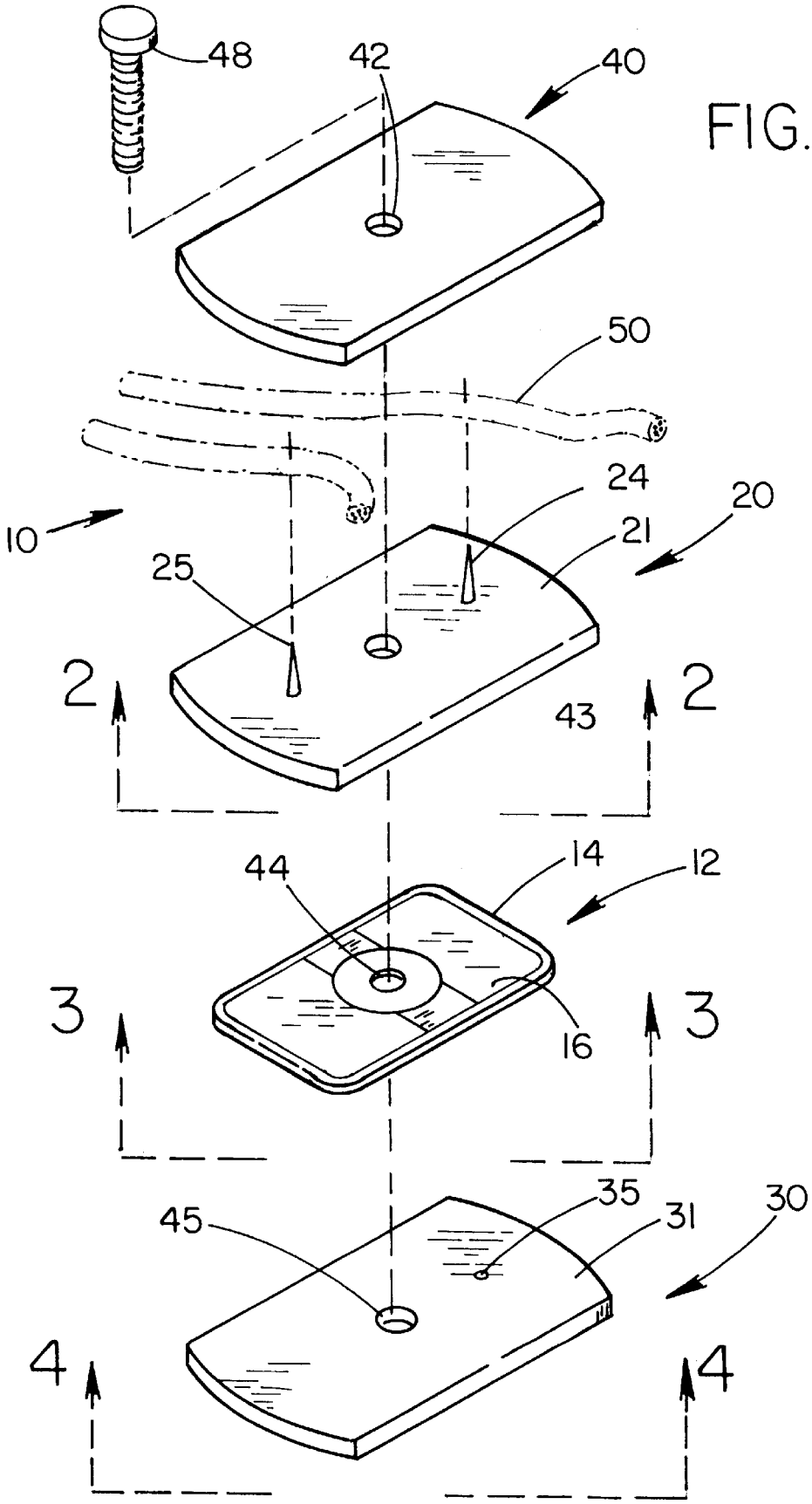
FIG. 1 is an exploded isometric illustration of the present invention.

With reference now to the drawings, and in particular to FIGS. 1 through 8 thereof, a new engine spark ignition system capacitive coupler embodying the principles and concepts of the present invention and generally designated by the reference numeral 10 will be described.

More specifically, it will be noted that the engine spark ignition system capacitive coupler 10 comprises a first plate 12 having at least two capacitors formed thereon in series, a second plate 20 having disposed therethrough at least two electrically conductive members 24 for electrically connecting the spark plug wires 50 to a first plate of a capacitor, a retaining plate 40 abuttable to the spark plug wires 50 and the first ends 25 of the conductive members 24 for retaining the conductive members 24 in electrical contact with the spark plug wires 50, a base plate 30 having an electrically conductive member 34 for electrical contact between the second plate of the capacitor and a male connector 36 by means of which a plurality of capacitors formed on the first plate 12 can be electrically connected in series, and a means for alignably attaching the base plate 30 to the first plate 12, the first plate 12 to the second plate 20, and the retaining plate 40 to the second plate 20.

With reference to FIGS. 1–6, the first plate 12 is shown including a first side 14 and a second side 15. The first side 14 is shown including at least two spaced, electrically conductive surface portions 16. Each conductive surface portions 16 form the first plate of capacitor. The second plate of each capacitor is formed by an electrically conductive surface portion 17 shown formed on the second side 15 of the first plate 12. The conductive surface portion 17 is formed in spaced and insulated relationship to the at least two conductive surface portions 16, as by etching a double sided circuit board.

A second plate 20 is alignable and abuttable to the first plate 12. The second plate is formed of an insulating material and includes a first side 21 and a second side 22, the second side 22 being abuttable to the first plate first side 14. The second plate 20 includes at least two spaced electrically conductive members 24 disposed therethrough. In the preferred embodiment, the conductive members 24 include pins having a sharp pointed first end 25 for facilitating contact with the spark plug wire 50. A second end 26 of the conductive member 24 is electrically contactable to one of the at least two surface portions 16, the conductive members 24 being operable to connect the current flowing through the spark plug wires 50 to the first plate of each capacitor.

A retaining plate 40 is shown alignable with the second plate 20. The retaining plate is formed of an insulating material and abuttable to the spark plug wires 50 and the first ends 25 of the conductive members 24 and retains the spark plug wires 50 in a fixed position relative to the capacitive coupler 10.

With continued reference to FIGS. 1–6, a base plate 30 is shown alignable and abuttable to the first plate 12. The base plate 30 is formed of an insulating material and includes a first side 31 and a second side 32, the base plate first side 31 being abuttable to the first plate second side 15. The base plate 30 includes an electrically conductive member 34 disposed therethrough which includes a first end 35 and a second end 36. The base plate conductive member first end 35 is electrically contactable to the second plate of the capacitors and the base plate conductive member second end 36 is shown disposed adjacent the base plate second side 32 and includes a male connector 36.

A means for alignably attaching the base plate 30 to the first plate 12, the first plate 12 to the second plate 20, and the retaining plate to the second plate 20 is shown including a bolt 48 formed of an insulating material which is receivable in a first threaded bore 42 formed in the center of the retaining plate 40, a first bore 43 formed in the center of the second plate 20, a second bore 44 formed in the center of the first plate 12, and a second threaded bore 45 formed in the center of the base plate 40. In the preferred embodiment, the retaining plate 40, the second plate 20, the first plate 12, and the base plate 30 are substantially rectangular. Additionally, the base plate 30, the first plate 12 and the second plate 20 may be bonded together in aligned and abutting relationship.

Figure 7:
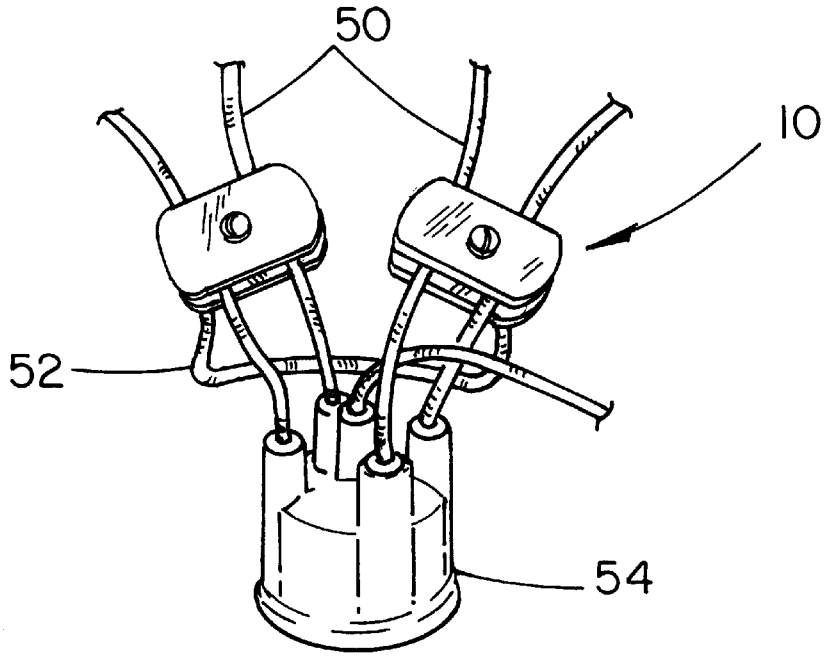
FIG. 7 is perspective view of the invention in use with a distributor cap of a four cylinder internal combustion engine.
Figure 8:
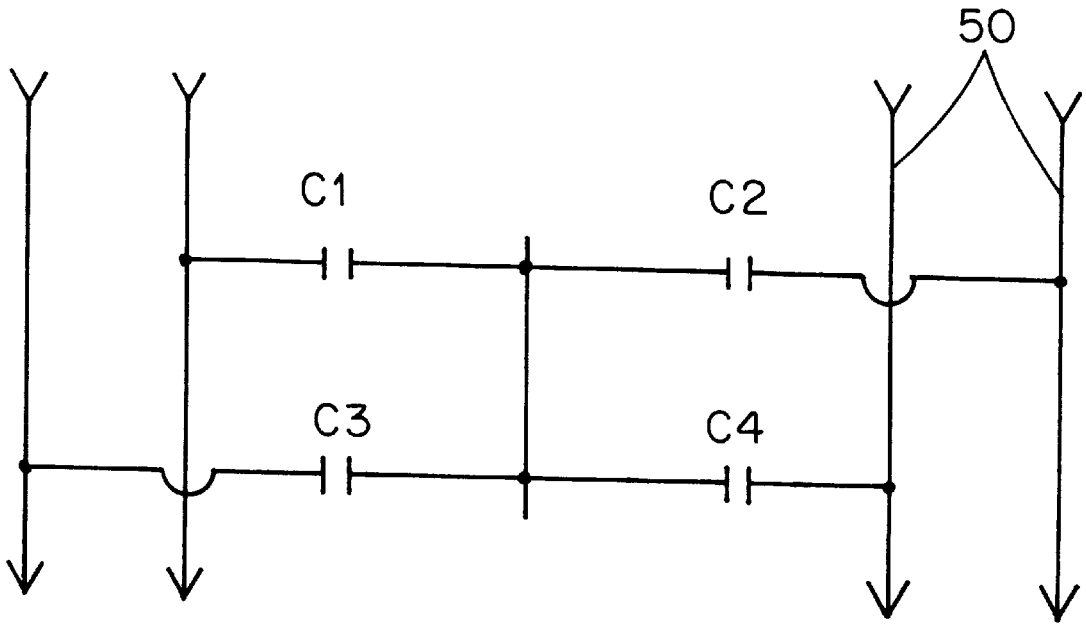
FIG. 8 is a schematic view showing a pair of coupler's in use.

In use, the capacitive coupler 10 is attachable to the spark plug wires 50 of an internal combustion engine as shown in FIG. 7. Two capacitive couplers 10 having two capacitors each are shown connected in series (FIG. 8) by means of a connecting wire 52 for use in a four cylinder engine. A single capacitive coupler 10 having four capacitors could be employed but it is found that for ease of installation, two couplers reduce the stress on the spark plug wires 50.

The changing voltage produced by the current through the firing spark plug wire induces a current through the capacitors connected to the non-firing spark plug wires and an electrostatic charge in injected into the combustion chamber with the hereinabove described effect upon the fuel/air mixture in the combustion chamber.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An engine spark ignition system capacitive coupler for use with an internal combustion engine having a plurality of spark plug wires connected between a distributor and a spark plug disposed in an engine cylinder, the capacitive coupler comprising:

a first plate having a first side and a second side, the first side having at least two spaced, electrically conductive surface portions, each surface portion forming a first plate of a capacitor, the second side having an electrically conductive surface portion disposed in spaced and insulated relationship to the at least two surface portions, the second side surface portion forming a second plate of each capacitor;

a second plate alignable and abuttable to the first plate, the second plate having a first side and a second side, the second side being abuttable to the first plate first side, the second plate having at least two spaced electrically conductive members disposed therethrough, each electrically conductive member having a first end and a second end, each second end being electrically contactable to one of the at least two surface portions, each first end being electrically contactable to a spark plug wire;

a retaining plate alignable with the second plate, the retaining plate being abuttable to the spark plug wires;

a base plate alignable and abuttable to the first plate, the base plate having a first side and a second side, the base plate first side being abuttable to the first plate second side, the base plate having an electrically conductive member disposed therethrough, the base plate electrically conductive member having a first end and a second end, the base plate electrically conductive member first end being electrically contactable to the first plate second side electrically conductive surface portion, the base plate electrically conductive member second end being disposed adjacent the base plate second side; and a means for alignably attaching the base plate to the first plate, the first plate to the second plate, and the retaining plate to the second plate.

2. The engine spark ignition system capacitive coupler of claim 1, wherein the means for alignably attaching the base plate to the first plate, the first plate to the second plate, and the retaining plate to the second plate further comprises first threaded bore formed in a center of the retaining plate, a first bore formed in the center of the second plate, a second bore formed in the center of the first plate, a second threaded bore formed in the center of the base plate, and a bolt receivable through the first threaded bore, the first bore, the second bore, and the second threaded bore.

3. The engine spark ignition system capacitive coupler of claim 1, wherein the base plate, the first plate, and the second plate are fixedly attached to each other in aligned and abutted relationship.

4. The engine spark ignition system capacitive coupler of claim 1, wherein the first end of each second plate electrically conductive member further comprises a pointed end.

5. The engine spark ignition system capacitive coupler of claim 1, wherein the second end of the base plate electrically conductive member further comprises a male connector.

6. The engine spark ignition system capacitive coupler of claim 1, wherein the base plate, the second plate, and the retaining plate are formed from an insulating material.

7. The engine spark ignition system capacitive coupler of claim 2, wherein the bolt is formed of an insulating material.

8. The engine spark ignition system capacitive coupler of claim 1, wherein the base plate, the first plate, the second plate, and the retaining plate are rectangular.

* * * * *